US008390474B2

(12) United States Patent
Yi et al.

(10) Patent No.: US 8,390,474 B2
(45) Date of Patent: Mar. 5, 2013

(54) METHOD FOR COLLECTING DATA AND SYSTEM FOR ACCOMPLISHING THE SAME

(75) Inventors: Ki Hak Yi, Windsor (CA); Kenneth L. Peirce, Grosse Pointe Farms, MI (US)

(73) Assignee: General Motors LLC, Detroit, MI (US)

( * ) Notice: Subject to any disclaimer, the term of this patent is extended or adjusted under 35 U.S.C. 154(b) by 416 days.

(21) Appl. No.: 12/768,426

(22) Filed: Apr. 27, 2010

(65) Prior Publication Data

US 2011/0260884 A1 Oct. 27, 2011

(51) Int. Cl.
*G08C 15/06* (2006.01)

(52) U.S. Cl. ..... 340/870.02; 340/870.07

(58) Field of Classification Search ..... 340/870.02, 340/870.07, 870.09, 426.16, 905, 539.13, 340/902, 903, 904, 425.5, 436; 702/3
See application file for complete search history.

(56) References Cited

U.S. PATENT DOCUMENTS

| | | | | |
|---|---|---|---|---|
| 6,615,186 | B1 | 9/2003 | Kolls | |
| 6,853,907 | B2 | 2/2005 | Peterson et al. | |
| 6,853,910 | B1 | 2/2005 | Oesterling et al. | |
| 6,900,740 | B2 | 5/2005 | Bloomquist et al. | |
| 7,010,289 | B2 | 3/2006 | Jijina | |
| 7,058,710 | B2 | 6/2006 | McCall et al. | |
| 7,113,852 | B2 | 9/2006 | Kapadia et al. | |
| 7,336,943 | B2 | 2/2008 | Crocker et al. | |
| 7,373,152 | B2 | 5/2008 | Oesterling | |
| 7,457,693 | B2 | 11/2008 | Olsen et al. | |
| 7,554,440 | B2 | 6/2009 | Kadaba | |
| 8,060,308 | B2 * | 11/2011 | Breed | 702/3 |
| 8,120,473 | B2 * | 2/2012 | Rennie et al. | 340/426.16 |
| 2002/0188522 | A1 | 12/2002 | McCall et al. | |
| 2004/0023645 | A1 | 2/2004 | Olsen et al. | |
| 2004/0054444 | A1 | 3/2004 | Abeska et al. | |
| 2005/0164695 | A1 | 7/2005 | Kamdar et al. | |
| 2005/0215200 | A1 | 9/2005 | Oesterling | |
| 2006/0190162 | A1 | 8/2006 | Ampunan et al. | |
| 2006/0217875 | A1 | 9/2006 | Oesterling et al. | |
| 2007/0112504 | A1 | 5/2007 | Krause et al. | |
| 2009/0051566 | A1 | 2/2009 | Olsen et al. | |
| 2009/0102681 | A1 | 4/2009 | Brennan, Jr. et al. | |
| 2009/0146839 | A1 | 6/2009 | Reddy et al. | |
| 2009/0289812 | A1 | 11/2009 | Kim et al. | |

FOREIGN PATENT DOCUMENTS

| | | |
|---|---|---|
| WO | WO 03/081560 | 10/2003 |

* cited by examiner

*Primary Examiner* — Joseph Lauture
(74) *Attorney, Agent, or Firm* — Dierker & Associates, P.C.

(57) ABSTRACT

A method for collecting data is disclosed herein. The method involves selecting, via a processor associated with a telematics service center, a mobile vehicle to collect data from a sensor configured to wirelessly communicate with one or more selected vehicles and, via a telematics unit disposed in the selected mobile vehicle, receiving data collected by the sensor. The method further involves, via the telematics unit, transmitting the data from the telematics unit to a data aggregator and reporting the data from the data aggregator to a facility. Also disclosed herein is a system for accomplishing the same.

18 Claims, 6 Drawing Sheets

METHOD FOR COLLECTING DATA AND SYSTEM FOR ACCOMPLISHING THE SAME

TECHNICAL FIELD

The present disclosure relates generally to methods and systems for collecting data.

BACKGROUND

Wireless sensors (such as, e.g., utility sensors, road traffic sensors, seismic sensors, or the like) are often used to obtain data associated with a particular utility for which the sensor is associated. In many cases, the data is transmitted to an appropriate facility such as, e.g., a billing, calling, or data processing center. Transmission of such data is often accomplished manually, for example, by dispatching a service representative to the sensor location. Such readings are taken and recorded on paper, in a computer or other electronic device, or via another recording method.

SUMMARY

A method for collecting data involves selecting, via a processor associated with a telematics service center, a mobile vehicle to collect data from a sensor configured to wirelessly communicate with one or more selected vehicles and, via a telematics unit disposed in the selected mobile vehicle, receiving data collected by the sensor. The method further involves, via the telematics unit, transmitting the data from the telematics unit to a data aggregator and reporting the data from the data aggregator to a facility.

A system for accomplishing the same is also disclosed herein.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Example(s) of the method as disclosed herein may advantageously be used to wirelessly collect data from one or more mobile or stationary sensors (e.g., sensors associated with private utility meters, sensors associated with public facility meters, road traffic sensors, water body level sensors, seismic sensors, etc.). More particularly, the method and system disclosed herein utilize a telematics unit of a subscriber vehicle to perform such data collection. This provides a mobile collection system in which one or more selected vehicles are used as collection points, and thus the number of fixed reading devices that are needed and/or utilized may be reduced.

It is to be understood that, as used herein, the term "user" includes a vehicle owner, operator, and/or passenger. It is further to be understood that the term "user" may be used interchangeably with the term subscriber/service subscriber.

Additionally, the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

Also, the term "communication" is to be construed to include all forms of communication, including direct and indirect communication. As such, indirect communication may include communication between two components with additional component(s) located therebetween.

Figure 1:
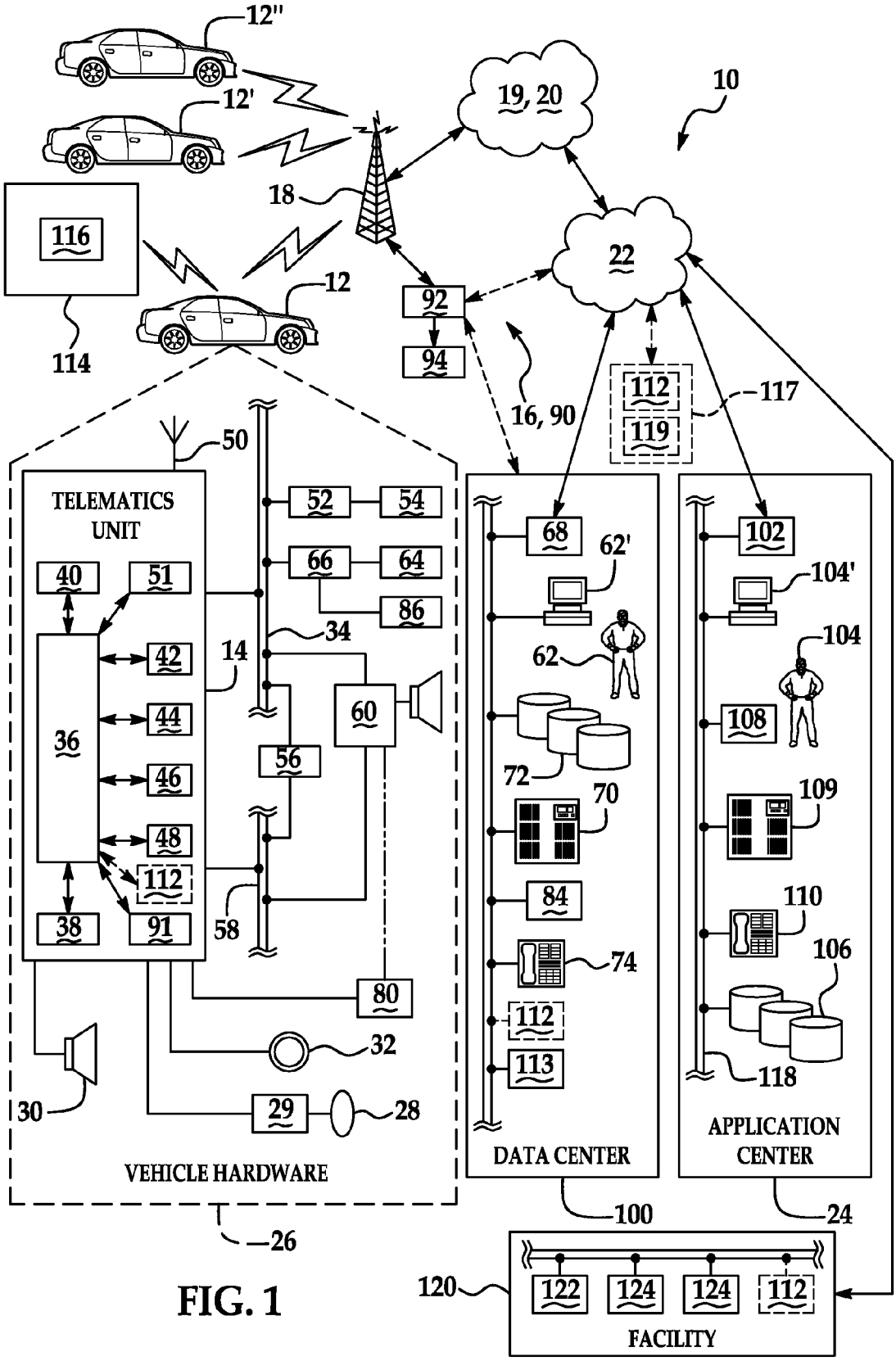
FIG. 1 is a schematic diagram depicting an example of a data collection system.

Referring now to FIG. 1, the system 10 includes one or more subscriber vehicles 12, 12', 12", the telematics unit 14 of each vehicle 12, 12', 12", a carrier/communication system 16 (which may include wired or wireless components, including, but not limited to, one or more cell towers 18, one or more base stations 19 and/or mobile switching centers (MSCs) 20, and one or more cellular service providers (not shown)), one or more land networks 22, one or more data centers 100, one or more application centers 24 (which may also be referred to as an application specific call center), one or more sensors 114 located external to the vehicles 12, 12', 12", a data aggregator 112 (located in the vehicles 12, 12', 12", at the data center 100, at a facility 120, or at a third party computing facility 117), and one or more facilities 120.

In an example, the carrier/communication system 16 is a two-way radio frequency communication system that enables both voice and data transmissions. The carrier/communication system 16 also includes one or more host servers 92 including suitable computer equipment (not shown) upon which information of a website resides/is stored. As disclosed herein, one of the websites may be a telematics services site and/or a telematics account managing site with which a remotely accessible page 94 (e.g., a webpage) is associated.

The overall architecture, setup and operation, as well as many of the individual components of the system 10 shown in FIG. 1 are generally known in the art. Thus, the following paragraphs provide a brief overview of one example of such a system 10. It is to be understood, however, that additional components and/or other systems not shown here could employ the method(s) disclosed herein.

Vehicles 12, 12', 12" are mobile vehicles such as a motorcycle, car, truck, recreational vehicle (RV), boat, plane, etc. Each of the vehicles 12, 12', 12" is equipped with suitable hardware and software that enables it to communicate (e.g., transmit and/or receive voice and data communications) over the wireless carrier/communication system 16 and/or with the sensor 114 via short range wireless communications. It is to be understood that each of the vehicles 12, 12', 12" may also include additional components suitable for use in the telematics unit 14.

Some of the vehicle hardware 26 is shown generally in FIG. 1, including the telematics unit 14 and other components that are operatively connected to the telematics unit 14. The hardware 26 of one of the telematics units 14 is shown in FIG. 1, but it is to be understood that each of the vehicles 12, 12', 12" is equipped with a similar telematics unit 14. Examples of such other hardware 26 components include a microphone 28, a speaker 30 and buttons, knobs, switches, keyboards, and/or controls 32. In an example, the microphone 28 is part of a voice module 29 that is configured to receive voice commands from, for example, the user. Generally, these hardware 26 components enable a user to communicate with the telematics unit 14 and any other system 10 components in communication with the telematics unit 14.

Operatively coupled to the telematics unit 14 is a network connection or vehicle bus 34. Examples of suitable network connections include a controller area network (CAN), a media oriented system transfer (MOST), a local interconnection network (LIN), an Ethernet, and other appropriate connections such as those that conform with known ISO, SAE, and IEEE standards and specifications, to name a few. The vehicle bus 34 enables the vehicle 12 to send and receive signals from the telematics unit 14 to various units of equipment and systems both outside the vehicle 12 and within the vehicle 12 to perform various functions, such as unlocking a door, executing personal comfort settings, and/or the like. In an example, the vehicle bus 34 also enables the telematics unit 14 to receive vehicle data from the various units of equipment and systems of the vehicle 12. Such vehicle data may include, but is not limited to, location-based data (e.g., a then-current location of the vehicle 12), infotainment data, video data or photographs taken, e.g., from the in-vehicle camera (not shown), data pertaining to vehicle operations (e.g., gas mileage, tire pressure, HVAC system operation, vehicle diagnostic information, urea levels, battery charge state, etc.), and/or the like.

The telematics unit 14 is an onboard device that provides a variety of services, both individually and through its communication with the application center 24 and/or data center 100. The telematics unit 14 generally includes an electronic processing device 36 operatively coupled to one or more types of electronic memory 38, a cellular chipset/component 40, a wireless modem 42, a navigation unit containing a location detection (e.g., global positioning system (GPS)) chipset/component 44, a real-time clock (RTC) 46, a short-range wireless communication network 48 (e.g., a BLUETOOTH® unit, an RFID tag, a dedicated short-range communication (DSRC) unit, a Wi-Fi unit, ZIGBEE®, etc.), a dual antenna 50, and/or a receiver 51. In one example, the wireless modem 42 includes a computer program and/or set of software routines executing within processing device 36. It is to be understood that telematics unit 14 may also include additional components and functionality as desired for a particular end use.

The electronic processing device 36 may be a micro controller, a controller, a microprocessor, a host processor, and/or a vehicle communications processor. In another example, electronic processing device 36 may be an application specific integrated circuit (ASIC). Alternatively, electronic processing device 36 may be a processor working in conjunction with a central processing unit (CPU) performing the function of a general-purpose processor.

The location detection chipset/component 44 may include a Global Position System (GPS) receiver, a radio triangulation system, a dead reckoning position system, and/or combinations thereof In particular, a GPS receiver provides accurate time and latitude and longitude coordinates of the vehicle 12 responsive to a GPS broadcast signal received from a GPS satellite constellation (not shown).

The cellular chipset/component 40 may be an analog, digital, dual-mode, dual-band, multi-mode and/or multi-band cellular phone. The cellular chipset-component 40 uses one or more prescribed frequencies in the 800 MHz analog band or in the 800 MHz, 900 MHz, 1900 MHz and higher digital cellular bands. Any suitable protocol may be used, including digital transmission technologies such as TDMA (time division multiple access), CDMA (code division multiple access) and GSM (global system for mobile telecommunications). In some instances, the protocol may be short-range wireless communication technologies, such as BLUETOOTH®, dedicated short-range communications (DSRC), or Wi-Fi.

Also associated with electronic processing device 36 is the previously mentioned real time clock (RTC) 46, which provides accurate date and time information to the telematics unit 14 hardware and software components that may require and/or request such date and time information. In an example, the RTC 46 may provide date and time information periodically, such as, for example, every ten milliseconds.

The vehicle bus 34 is configured to be in operative communication with the sensor(s) 114 (i.e., those that are located outside of the vehicle 12) that monitor one or more utilities. As used herein, the term "utility" refers to a commodity associated with a service that is measurable by the sensor(s) 114 (e.g., gas and electricity provided by a utility company that is measurable by a suitable sensor), a condition that is measurable by the sensor(s) 114 (e.g., a then-current water level of a river measurable by a water body level sensor), or a happening/occurrence that is measurable by the sensor(s) 114 (e.g., an earthquake measurable by a seismic sensor). It is to be understood that the sensor(s) 114 generally represent one or more particular types of sensors (e.g., seismic sensors, nuclear radiation level sensors, etc.) that are capable of monitoring a particular type of utility (as defined above). As such, the system 10 may include a number of sensors 114, each representing a different type of sensor 114 that can monitor a respective type of utility. The sensor 114 may, on the other hand, represent a single sensor that is configured to monitor more than one type of utility (e.g., gas use for a private residence, electric use for a private residence, and seismic activity of the geographic area within which the residence is located). The sensor(s) 114 may, for example, by operatively connected to a private home or a public facility (e.g., a nuclear power plant). In some instances, the sensor(s) 114 (e.g., a road traffic sensor) may be operatively connected to (or in some cases, embedded in) a road segment. The sensor(s) 114 may also represent a plurality of sensors embodied in a single meter or area, where such sensors can link to one another depending upon the short-range wireless communication link/network 116 capabilities of the sensors 114. In this particular example, each of the sensors is configured to monitor a particular type of utility for a particular application. For instance, multiple sensors in the same box or area may include a sensor configured to monitor a power usage of a residence, another sensor configured to monitor a gas usage of a residence, and yet another sensor configured to monitor a water usage of a residence. The sensor(s) 114 may also include a real time clock (not shown) that can transmit a time and/or date stamp with a data message including the raw sensor 114 data. The time and/or date stamp may otherwise be obtained from the real time clock 46 operatively connected to the telematics unit 14, or from the GPS component 44. In instances where the real time clock 46 is used to obtain the time stamp, the time is provided in terms of code division multiple access (CDMA) time. Further, in instances where the GPS component 44 is used to obtain the time stamp, the time is provided in terms of coordinated universal time (UTC).

It is to be understood that both the sensor(s) 114 and each of the telematics units 14 participating in data collection and transmission as described herein are configured with appropriate hardware and/or software for wirelessly communicating with each other. Such communications often take place via some short-range wireless communication network(s) (such as those previously mentioned) which exchange data over short length radio waves. For example, the short-range wireless communication link/network 116 of the sensor(s) 114 links up with short-range wireless communication network 48 in the vehicle 12 and transmits signals (e.g., radio frequency signals) indicative of the conditions sensed by the sensor(s) 114 to the receiver 51 in operative communication with the vehicle bus 34. As described further hereinbelow, it is to be understood that the short-range wireless communication link/network 116 will also be able to authenticate the telematics unit 14 (and associated receiver 51) prior to transmitting any collected data. Generally, the receiver 51 acts as a temporary repository for the received signals (e.g., data), until such data is pulled from or pushed to the vehicle bus 34, and transmitted to the data aggregator 112.

Once received at the vehicle 12, the sensor data may be transmitted to the data aggregator 112 during a voice connection in the form of packet data over a packet-switch network 96 (e.g., voice over Internet Protocol (VoIP), communication system 16, etc.). The telematics unit 14 includes a vehicle data upload (VDU) system 91 or is interfaced to the VDU system 91. As used herein, the VDU system 91 is configured to receive raw sensor 114 data from the receiver 51, packetize the data and place the data into a suitable format for uniform transmission to the data aggregator 112, and upload the packetized data message to the data aggregator 112. In some cases, the data received from the sensor(s) 114 may already be packetized, and in such instances, the VDU 91 will simply revise the format for uniform transmission of the data to the data aggregator 112. Revising the format may include, for example, re-packetizing the data for transmission over the wireless communication system 16 (which may require a different format than the format required for short range-wireless technology used to receive the sensor data in the vehicle 12). In one example, the VDU 91 is operatively connected to the processor 36 of the telematics unit 14, and thus is in communication at least with the data aggregator 112 via the bus 34 and the communication system 16. In another example, the VDU 91 may be the telematics unit's central data system that can include its own modem, processor, and on-board database. The database can be implemented using a separate network attached storage (NAS) device or be located elsewhere, such as in the memory 38, as desired. The VDU 91 has an application program that handles all of the vehicle data upload processing, including communication with the data aggregator 112, and the setting and processing of triggers (i.e., preset indicators of when data, recordings, etc. are to be collected and/or uploaded).

The VDU 91 is also in operative communication with the short-range wireless communication network 48, and in some examples, when a triggering event is recognized by the VDU 91, it commands the short-range wireless communication network 48 to scan for short-range wireless communication network 116 associated with the sensor(s) 114. Once the short-range wireless communication network 48 links to short-range wireless communication network 116, the VDU 91 requests that data be transmitted from the sensor 114 to the receiver 51. In other instances, such a request will not be used, because the sensor(s) 114 will be transmitting data consistently during ON periods thereof. These and other forms of data collection and transmission will be described further herein in reference to FIGS. 2 through 9.

The telematics unit 14 provides numerous services, some of which may not be listed herein, and is configured to fulfill one or more user or subscriber requests. Several examples of such services include, but are not limited to: turn-by-turn directions and other navigation-related services provided in conjunction with the GPS based chipset/component 44; airbag deployment notification and other emergency or roadside assistance-related services provided in connection with various crash and or collision sensor interface modules 52 and sensors 54 located throughout the vehicle 12; and infotainment-related services where music, webpages, movies, television programs, videogames and/or other content is downloaded by an infotainment center 56 operatively connected to the telematics unit 14 via vehicle bus 34 and audio bus 58. In one non-limiting example, downloaded content is stored (e.g., in memory 38) for current or later playback.

Again, the above-listed services are by no means an exhaustive list of all the capabilities of telematics unit 14, but are simply an illustration of some of the services that the telematics unit 14 is capable of offering.

Vehicle communications generally utilize radio transmissions to establish a voice channel with carrier system 16 such that both voice and data transmissions may be sent and received over the voice channel. Vehicle communications are enabled via the cellular chipset/component 40 for voice communications and the wireless modem 42 and/or VDU 91 for data transmission. In order to enable successful data transmission over the voice channel, wireless modem 42 and/or VDU 91 applies some type of encoding or modulation to convert the digital data so that it can communicate through a vocoder or speech codec incorporated in the cellular chipset/component 40. It is to be understood that any suitable encoding or modulation technique that provides an acceptable data rate and bit error may be used with the examples disclosed herein. Generally, dual mode antenna 50 services the location detection chipset/component 44 and the cellular chipset/component 40.

The voice module 29, via the microphone 28, provides the user with a means for inputting verbal or other auditory commands, and can be equipped with an embedded voice processing unit utilizing human/machine interface (HMI) technology known in the art. Conversely, speaker 30 provides verbal output to the vehicle occupants and can be either a stand-alone speaker specifically dedicated for use with the telematics unit 14 or can be part of a vehicle audio component 60. In either event and as previously mentioned, microphone 28 and speaker 30 enable vehicle hardware 26, data center 100, application center 24, and/or facility 120 to selectively communicate with the occupants through audible speech. The vehicle hardware 26 also includes one or more buttons, knobs, switches, keyboards, and/or controls 32 for enabling a vehicle occupant to activate or engage one or more of the vehicle hardware components. In one example, one of the buttons 32 may be an electronic pushbutton used to initiate voice connection/communication with the data center 100 (whether it be a live advisor 62 or an automated call response system 62') or with the application center 24 (also whether it be a live advisor 104 or an automated call response system 104'). As one example, one of the buttons 32 may be utilized to initiate a voice call to the data center 100 to sign up for a particular service (e.g., the telematics unit metering service disclosed herein). As another example, one of the buttons 32 may be used to initiate emergency services.

The audio component 60 is operatively connected to the vehicle bus 34 and the audio bus 58. The audio component 60 receives analog information, rendering it as sound, via the audio bus 58. Digital information is received via the vehicle bus 34. The audio component 60 provides AM and FM radio, satellite radio, CD, DVD, multimedia and other like functionality independent of the infotainment center 56. Audio component 60 may contain a speaker system, or may utilize speaker 30 via arbitration on vehicle bus 34 and/or audio bus 58.

Still referring to FIG. 1, the vehicle crash and/or collision detection sensor interface 52 is/are operatively connected to the vehicle bus 34. The crash sensors 54 provide information to the telematics unit 14 via the crash and/or collision detection sensor interface 52 regarding the severity of a vehicle collision, such as the angle of impact and the amount of force sustained.

Other vehicle sensors 64, connected to various sensor interface modules 66 are operatively connected to the vehicle bus 34. Example vehicle sensors 64 include, but are not limited to, gyroscopes, accelerometers, magnetometers, emission detection and/or control sensors, environmental detection sensors, and/or the like. One or more of the sensors 64 enumerated above may be used to obtain the vehicle data for use by the telematics unit 14 or the data center 100 to determine the operation of the vehicle 12. Non-limiting example sensor interface modules 66 include powertrain control, climate control, body control, and/or the like.

In a non-limiting example, the vehicle hardware 26 includes a display 80, which may be operatively directly connected to or in communication with the telematics unit 14, or may be part of the audio component 60. Non-limiting examples of the display 80 include a VFD (Vacuum Fluorescent Display), an LED (Light Emitting Diode) display, a driver information center display, a radio display, an arbitrary text device, a heads-up display (HUD), an LCD (Liquid Crystal Diode) display, and/or the like.

In an example, the telematics unit 14 further includes the data aggregator 112, which is a computer module (separate from the processor 36) that receives and bins the data transmitted from the sensor(s) 114 to the telematics unit 14. In some aspects, the data aggregator 112 is simply a data repository. In other aspects, the data aggregator 112 is also capable of running computer readable code/software routines for receiving the sensor 114 data and for determining which facility 120 to transmit the data to. For instance, upon processing the data, the data aggregator 112 may deduce that sensor 114 data associated with gas usage measurements of the vehicle owner's residence should be transmitted to the owner's gas company, and then reports the data to this facility. The reporting of the data may be accomplished via a wireless connection, a landline, the Internet, a short message service message, and/or the like. In an example, the data aggregator 112 further includes suitable computer readable code for filtering the data and/or for performing data conditioning processes to place such data in form for transmission to the proper facility 120.

In an example, the data messages transmitted by the sensor(s) 114 are encoded; however, an uncoded and/or unencrypted identification number of the sensor(s) 114 transmitting the data may be included in the otherwise encoded message. The data aggregator 112 can use this identification number as a query in a list of sensor identification numbers (e.g., stored in the memory 38, in the databases 72 at the data center 100, or the like). The memory 38, databases 72, etc. may also include information that correlates the identification number of the sensor 114 with the proper facility 120 to which the data should be sent. In another example, the sensor 114 data is not encrypted, and therefore is readable by the data aggregator 112. From such data, the data aggregator 112 can determine the type of data received and the facility 120 associated with the sensor 114.

The data aggregator 112 may otherwise reside at a third party computing facility 117 that is in selective and operative communication with the telematics unit 14. In this example, the sensor 114 data obtained by the telematics unit 14 is transmitted to the third party computing facility 117, where such data is processed by the data aggregator 112. Via a communications module 119 associated with the third party computing facility 117, the processed data (which, e.g., may also have been filtered, conditioned, or the like by the data aggregator 112) is transmitted to the proper facility 120.

In yet another example, the data aggregator 112 is embodied at the data center 100 as a data aggregation module, which is in selective and operative communication with the telematics unit 14 via communication system 16. The sensor 114 data is transmitted to and received by the data center 100, and such data is processed by the data aggregator 112. Via a communications module 113 at the data center 100, the processed data is transmitted to the proper facility 120.

Still further, the data aggregator 112 may be embodied at the facility 120 as a data aggregation module, which is in selective and operative communication with the telematics unit 14 via communication system 16. This example may be used, e.g., when facility 120 requests sensor 114 data directly from the telematics unit 14. The sensor 114 data is transmitted to and received by the facility 120, and such data is processed by the data aggregator 112.

In an example, the system 10 includes a single data aggregator 112 located at one of the data center 100, the facility 120, or the third party computing facility 117. In another example, the system 10 includes a number of data aggregators 112 (such as, e.g., a data aggregator 112 at the data center 100, the facility 120, and at the third party computing facility 117). In this example, there may be a default aggregator, to which sensor 114 data is sent unless the data is requested by a facility 120 that is associated with a specific data aggregator 112. In such instances, the default aggregator would be overridden, and the data is sent to the aggregator 112 of the requesting facility. In yet another example, the system 10 may include aggregators 112 having different levels of processing on different computing platforms. For instance, sensor 114 data reaching, e.g., an alarm level of usage, emittance, etc. of a particular type of utility (e.g., a radiation level exceeding a certain threshold), the data may be passed directly to a data aggregator 112 associated with the radiation facility, or to the radiation facility itself.

The carrier/communication system 16 may be a cellular telephone system or any other suitable wireless system that transmits signals between the vehicle hardware 26 and land network 22. According to an example, wireless carrier/communication system 16 includes one or more cell towers 18, base stations 19 and/or mobile switching centers (MSCs) 20, as well as any other networking components required to connect the wireless system 16 with land network 22. It is to be understood that various cell tower/base station/MSC arrangements are possible and could be used with wireless system 16. For example, a base station 19 and a cell tower 18 may be co-located at the same site or they could be remotely located, and a single base station 19 may be coupled to various cell towers 18 or various base stations 19 could be coupled with a single MSC 20. A speech codec or vocoder may also be incorporated in one or more of the base stations 19, but depending on the particular architecture of the wireless network 16, it could be incorporated within an MSC 20 or some other network components as well.

Land network 22 may be a conventional land-based telecommunications network that is connected to one or more landline telephones and connects wireless carrier/communication network 16 to the data center 100 and/or to the application center 24. For example, land network 22 may include a public switched telephone network (PSTN) and/or an Internet protocol (IP) network. It is to be understood that one or more segments of the land network 22 may be implemented in the form of a standard wired network, a fiber or other optical network, a cable network, other wireless networks such as wireless local networks (WLANs) or networks providing broadband wireless access (BWA), or any combination thereof.

Data center 100 is designed to provide the vehicle hardware 26 with a number of different system back-end functions. Generally, the data center 100 receives voice and/or data calls, analyzes requests associated with the voice or data calls, and, in some cases, services such calls, and in other cases, transfers the call to an application specific call/service center (such as the application center 24 shown in FIG. 1, which will be described in detail below). The data center 100 is in selective and operative communication with the application center 24 via the wireless carrier/communication system 16 or via a wired connection. Additionally, for purposes of the instant disclosure, the data center 100 is in selected and operative communication with the telematics unit 14 and the host server 92, and is configured to operate an account managing webpage 94 for one or more subscribers.

According to the example shown here, the data center 100 generally includes one or more switches 68, servers 70, databases 72, live and/or automated advisors 62, 62', a processor 84, various modules (such as, e.g., a communications module 113), as well as a variety of other telecommunication and computer equipment 74 that is known to those skilled in the art. These various data center components are coupled to one another via a network connection or bus 76, such as one similar to the vehicle bus 34 previously described in connection with the vehicle hardware 26.

The processor 84, which is often used in conjunction with the computer equipment 74, is generally equipped with suitable software and/or programs configured to accomplish a variety of data center 100 functions. The processor 84 may further be configured to run programs for performing some of the application center 24 back end functions. More particularly, the various operations of the data center 100 are carried out by one or more computers (e.g., processor 84, computer equipment 74, etc.) programmed to carry out the tasks of the method(s) disclosed herein. The computer equipment 74 (including computers) may include a network of servers (including server 70) coupled to both locally stored and remote databases (e.g., database 72) of any information processed.

Switch 68, which may be a private branch exchange (PBX) switch, routes incoming signals so that voice transmissions are usually sent to either the live advisor 62 or the automated response system 62', and data transmissions are passed on to a modem or other piece of equipment (not shown) for demodulation and further signal processing. The modem preferably includes an encoder, as previously explained, and can be connected to various devices such as the server 70 and database 72. In either instance, the entity (e.g., 62, 62' or modem) of the data center 100 receiving the transmission determines (by asking the caller or by analysis of the data) who/what is calling, the need/request of the calling entity, and where to further direct the call to obtain the desired assistance.

In an example, the switch 68 may receive a voice call from the user requesting to, or responding to a request to join a telematics data collection service. In this example, the switch 68 routes the voice call to the advisor 62, 62' who will guide the user through the sign up process.

The application center 24 may be a dedicated facility for managing and handling transmissions related to the telematics data collection service (also referred to herein as a data collection program). In this particular example, upon receiving a voice call, the switch 68 routes the voice call to the switchboard 102 at the telematics data collection application center 24 (which may also be a website application center including a telematics data collection division), and then such call is routed by the switchboard 102 to an appropriate application center advisor 104, 104' who will assist the caller. In this particular example, upon receiving a data call, the switch 68 routes the data call to the switchboard 102 at the telematics data collection application center 24, and then such call is routed by the switchboard 102 to an advisor 104, 104' that will assist a user in signing up for the program/services.

Referring back to the description of the data center 100, it is to be understood the database(s) 72 may be designed to store subscriber profile records, subscriber behavioral patterns, or any other pertinent subscriber information. The database(s) 72 may also allow the data center 100 to function as a repository for data collected from the telematics unit 14 and/or from the application center 24. In some instances, another facility may function as a repository for the collected data (e.g., a lab (not shown) associated with the application center 24 and/or the data center 100).

The communications module 113 is configured, via suitable communications equipment (such as equipment capable of handling messaging between the data center 100 and the telematics unit 14 (e.g., VehComm), modems, TCP/IP supporting equipment, and/or the like), to enable the data center 100 to establish a communication with the telematics unit 14, or visa versa. In instances where the data aggregator 112 is embodied at the data center 100 as a data aggregation module, the communications module 113 is capable of receiving data messages (i.e., packet data) from the telematics unit 14, identify that the data is sensor 114 data (e.g., via a sensor identification number present within and readable from the message), and transmit such data messages to the data aggregation module 112. The data aggregation module 112 runs computer readable code/software routines that can receive the packet data, determine the facility that is associated with the received data, and transmit such data to the proper facility 120.

It is to be appreciated that the data center 100 may be any central or remote facility, manned or unmanned, mobile or fixed, to or from which it is desirable to exchange voice and data communications. Furthermore, the live advisor 62 may be physically present at the data center 100 or may be located remote from the data center 100 while communicating therethrough.

The application center 24, which is in selective and operative communication with the data center 100, is a dedicated facility for addressing specific requests, needs, or the like of the user, the data center 100, or both. In an example, several application centers 24 may be associated with the data center 100, where each application center is designed to address the specific request, need, etc. Examples of such application centers 24 include, but are not limited to, emergency service centers, navigation route centers, telematics data collection program centers, or the like.

As shown in FIG. 1, the application center 24 may include a switchboard 102, databases 106, live and/or automated advisors 104, 104', the processor(s) 108, a server 109, as well as a variety of other telecommunication and computer equipment 110 that is known to those skilled in the art. In some instances, the application center 24 may also include various modules (similar to, for example, the data aggregating module 112, the communications module 113, etc.). In such instances, the modules at the application center 24 may be used to perform the functions described above for the communications module 113 and the data aggregation module 112 (if one exists) of the data center 100. These various application center components are coupled to one another via a network connection or bus 118, such as one similar to the vehicle bus 34 or the data center bus 76 described above.

Switchboard 102, which may be a private branch exchange (PBX) switch, routes incoming signals so that voice transmissions (e.g., voice calls) are usually sent to either the live advisor 104 or the automated response system 104', and data transmissions (e.g., packetized voice communications) are passed on to a modem or other piece of equipment (not shown) for demodulation and further signal processing. The modem preferably includes an encoder, as previously explained, and can be connected to various devices such as the server 109 and database 106.

The database(s) 106 may be designed to store a variety of information usable by the application center 24. When the application center 24 is a navigation route service center, the database(s) 106 may store various routes and/or points of interest often requested by a particular user. When the application center 24 is a telematics data collection center, the database(s) 106 may be designed to store timestamps of sensor 114 data upload events in an archive.

Referring back to the general functions of the application center 24, it is to be understood that similar to the data center live advisor 62, the application center live advisor 104 may be physically present at the application center 100 or may be located remote from the application center 24 while communicating therethrough.

The system 10 also includes cellular service provider (not shown) that owns and/or operates the carrier/communication system 16. It is to be understood that, although the cellular service provider (not shown) may be located at the data center 100 or application center 24, both the data center 100 and the application center 24 are separate and distinct entities from the cellular service provider. In an example, the cellular service provider is located remote from the data center 100 and the application center 24. A cellular service provider provides the user with telephone and/or Internet services, while the data center 100 and the application center 24 are telematics service providers. The cellular service provider is generally a wireless carrier (such as, for example, Verizon Wireless®, AT&T®, Sprint®, etc.). It is to be understood that the cellular service provider may interact with the data center 100 and/or the application center 24 to provide various service(s) to the user.

The system 10 also includes the facility 120, which in many cases is a third party to the subscriber vehicles 12, 12', 12", the data center 100, and the application center 24. This facility 120 may be in selective operative communication with the data center 100 and/or application center 24, the vehicles 12, 12', 12" via communication system 16, the third party computing facility 117, or wherever the data aggregator 112 resides. The facility 120 includes at least a processor 122 and other computer equipment 124 that is able to establish a data communication to receive the sensor 114 data from the data aggregator 112. The processor 122 is also configured with software routines that are able to decode/decrypt the data messages. In some instances, the facility 120 also has one or more database(s) 126 configured to store therein sensor 114 data, data collection program subscriber information, etc.

The facility 120 is also a business facility that enters into an agreement with both the telematics service provider (that owns and operates the data and application centers 100, 24) and also with the subscriber vehicles 12, 12', 12". Such business facilities 120 may be utility providers (e.g., water company, gas company, electric company, etc.), privately-owned facilities (such as, e.g., oil or nuclear power facilities), government facilities (e.g., road traffic facilities), municipalities that monitor natural occurrences (e.g., earthquakes, tornados, hurricanes, or other weather-related occurrences), colleges and universities, and/or the like.

Figure 2:
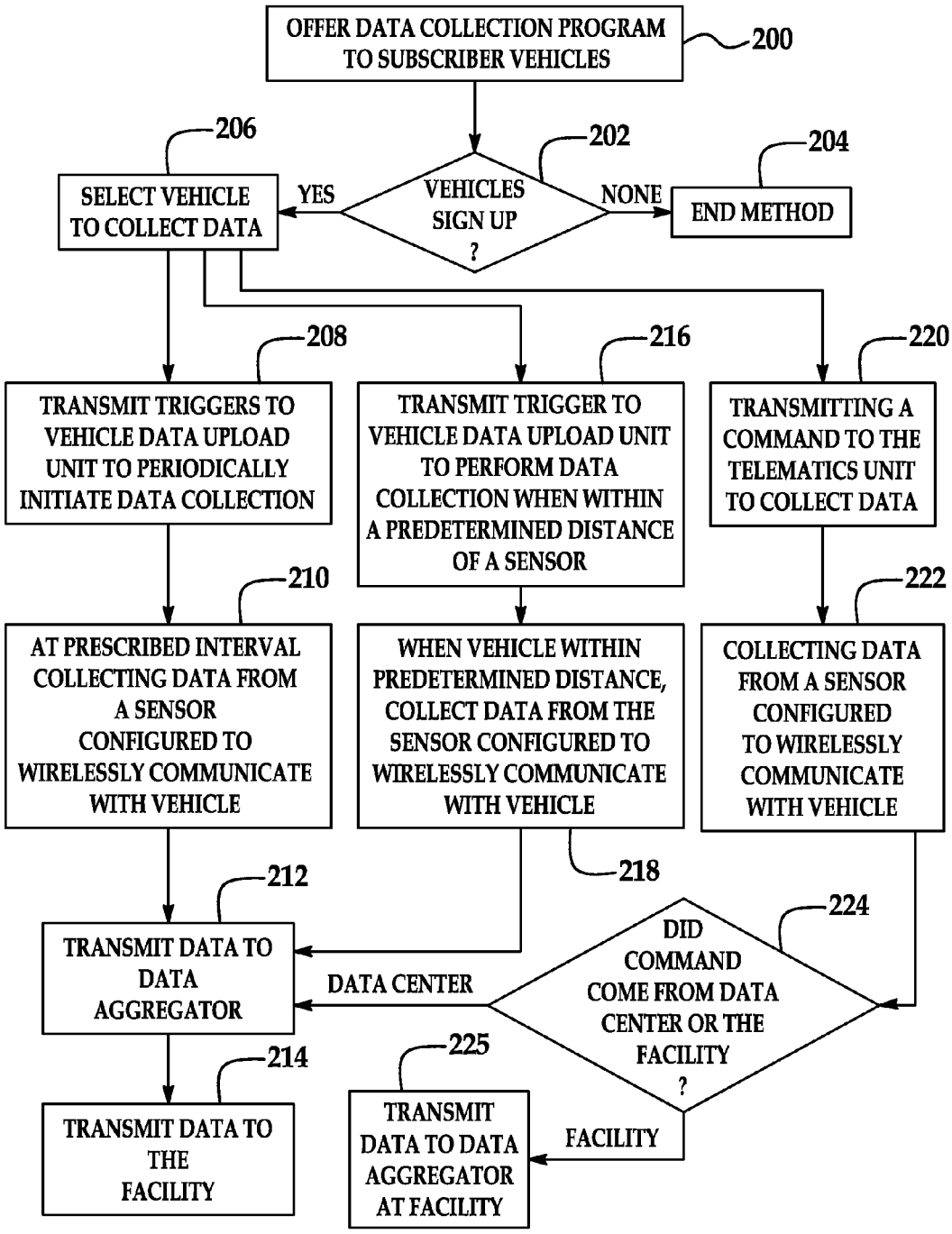
FIG. 2 is a flow diagram depicting examples of the method for collecting data.

Referring now to FIG. 2, various embodiments of the method for collecting data will be discussed. It is to be understood that other figures (i.e., FIGS. 3 and 5) may also be referenced throughout the discussion of FIG. 2.

At the outset, the facility 120 enters into a contract or some agreement with the telematics service provider to utilize one or more subscriber vehicles 12, 12', 12" to collect sensor data from sensor(s) 114 owned and operated by the facility 120. This provides the facility 120 with a mobile collection system which is reliable and secure. Once this agreement is in place, the telematics service provider may offer to its subscriber vehicles 12, 12', 12" the opportunity to participate in the telematics data collection program. As shown at reference numeral 200 in FIG. 2, the telematics service provider will offer the telematics data collection service/program to its subscriber vehicles 12, 12', 12". As illustrated in FIG. 2, if no vehicles sign up, the method ends (see reference numerals 202 and 204). However, if at least one vehicle 12 signs up, the method continues (reference numerals 202 and 206 et seq.). As such, the examples of the method disclosed herein may be accomplished so long as an account has been set up with the data center 100, and the owner of the account has joined a data collection program provided by the telematics service provider in conjunction with the facility 120. As used herein, the term "account" refers to a representation of a business relationship established between the user and the telematics service provider, where such business relationship enables the user to request and receive services from the data center 100 and, in some instances, the application center 24. The business relationship may be referred to as a subscription agreement/contract between the user and the owner of the data center 100 and application center 24, where such agreement generally includes, for example, the type of services that the user may receive, the cost for such services, the duration of the agreement (e.g., a one-year contract, etc.), and/or the like. In an example, the account may be set up by calling the data center 100 (e.g., by dialing a phone number for the data center 100 using the user's cellular, home, or other phone) and requesting (or selecting from a set of menu options) to speak with an advisor 62 to set up an account. In an example, the switch 68 at the data center 100 routes the call to an appropriate advisor 62, who will assist the user with opening and/or setting up the user's account. When the account has been set up, the details of the agreement established between the data center 100/application center 24 owner (i.e., the telematics service provider) and the user, as well as personal information of the user (e.g., the user's name, garage address, home phone number, cellular phone number, electronic mailing (e-mail) address, etc.) are stored in a user profile in the database 72 at the data center 100. The user profile may be used by the telematics service provider, for example, when providing requested services or offering new services to the user.

When the data collection program becomes available, the data center 100 or the application center 24 may notify the user of such services during a voice call between the user and data center 100 or the application center 24. Such a call may be initiated by either the user or the data or application center 100 or 24. During the call, the advisor 62 or 104 may notify the user of the service, and also ask the user if he/she would be interested in signing up for the service. If the user is conversing with an advisor 62, 62' at the data center 100 when he/she indicates that he/she would be interested in the data collection service, the advisor 62, 62' i) may sign the user up, ii) may provide the user with a phone number that he/she may use to directly sign up for the service, or iii) may route the user's call to an appropriate division at the data/application center 100, 24 to sign up for the service.

In another example, the user may be solicited by the data center 100 (or application center 24 if designated for supporting the specific service). In one example of such a solicitation, an advisor 62 at the data center 100 calls the user directly on his/her cellular phone. During the call, the user may be informed of the availability of the new data collection program, and invite the user to sign up. The user may sign up for the service, if he/she so desires, during the same voice call with the data center 100. In another example of such a solicitation, the data center 100 (or application center 24 if designated for supporting the specific service) may transmit an invitation to a user's account to join the data collection program. In this example, the data center 100 may retrieve the user's e-mail address from his/her profile stored in the database 72, and then e-mail the invitation to the user. The invitation also includes instructions indicating how the user can go about signing up for the data collection program, and a phone number for directly accessing an appropriate division at the data center 100 (or application center 24). Using the phone number listed in the invitation, the user may directly contact the division, and sign up for the data collection program during the phone call.

When sent in an electronic mail format, the invitation to join the data collection program may also include a hyperlink that, when selected (e.g., via a mouse click) by the user, takes the user to a webpage (e.g., webpage 94) associated with the data center 100 or the application center 24. The user may then sign up for the data collection program using that webpage 94.

Once the user has signed up for the telematics data collection service/data collection program, the processor 84 at the data center 100 will select the user's vehicle 12 for data collection (see reference numeral 206). This selection process will involve marking/flagging the user's profile as a participating vehicle 12 for the length of time the user has agreed to, and will also involve configuring the telematics unit 14 of the vehicle 12 for data collection from one or more particular/participating sensor(s) 114. As one example, if the user has signed up to collect water usage data from his/her water meter, the telematics unit 14 will have to be configured to wirelessly communicate with the sensor(s) 114 associated with that particular water meter. This configuration will take place when the vehicle 12 is within a predetermined distance of the meter with which it will communicate. This can be accomplished by creating a profile of the telematics unit 14 that is readable by the communications system 116 associated with the sensor(s) 114 of the meter. The processor 84 instructs the telematics unit 14 (via a data message) to transmit its profile when the vehicle 12 is located within the range of the respective short-range wireless communication systems 48, 116. The security protocols of such a profile enable a safe and secure connection for the transmission of data. When pairing a telematics unit 14 with the sensor(s) 114, the telematics unit 14 transmits its profile (e.g., identifier or name, class, list of services and technical specifications) to the sensor 114 so that the sensor(s) 114 can recognize the telematics unit 14 and communicate therewith (sometimes exclusively, unless additional telematics units 14 are linked thereto). The devices 14, 114 will interact with one another and transmit the appropriate data as long as the profile of the telematics unit 14 is stored in the sensor(s) 114 (e.g., in a memory, not shown in FIG. 1). In another example, a table of sensors 114 may be resident on the telematics unit 14 (e.g., stored in the memory 38), and this table may be utilized by the telematics unit 14 to determine from which sensor(s) 114 to obtain data. This table may, in some respects, act as a filter of all of the sensors 114 that the telematics unit 14 is capable of, but not necessarily authorized to obtain data from. It is to be understood that multiple sensor(s) 114 may be configured to transmit data to a single telematics unit 14, depending upon the agreement between the user and the third party facility 120.

As another example, if the user has signed up to collect data from any sensor 114 of the facility 120 (e.g., if the facility 120 is a public facility that has associated therewith a plurality of sensors 114, and the vehicle 12 signed up for the data collection program where the vehicle 12 collects data from each of the plurality of sensors 114) that is within the short-range communication ability of the telematics unit 14, the telematics unit 14 will have to be configured to wirelessly communicate with such sensors 114. In this example, the telematics unit 14 may be programmed to scan one or more channels for data being broadcast from the participating sensors 114. In this example, the profile of the telematics unit 14 is not recognized by the sensor 114, but rather the telematics unit 14 will be configured to receive broadcast data when the broadcast data includes an identifier of the sensor 114 and/or facility 120 that is recognizable by the processor 36 of the telematics unit 14.

It is to be understood that the vehicle 12 will continue to collect data from the sensor(s) 114 for the amount of time defined in the user's participation agreement. For instance, if the user signs up for six months, the telematics unit 14 may be programmed to collect data until the expiration of the six months, or until being reconfigured to cease such data collection. When the six month duration is about to elapse (e.g., two weeks before the expiration, or at some other predefined period), for example, the data center 100 may transmit one or more renewal invitations to the user to re-sign up for the program.

Once the vehicle 12 (and/or 12', 12") has been selected and linked to or configured to collect data from the sensor(s) 114, the telematics unit 14 will be instructed to collect data in some desirable manner. In some instances, data collection takes place i) at predefined intervals and when the telematics unit is within a predetermined distance of the sensor(s) 114, ii) when the telematics unit 14 is within a predetermined distance of the sensor(s) 114, or ii) on demand in response to a command from the facility 120 or from the data center 100.

As shown at reference numerals 208 through 214, one example of the method involves transmitting data at predefined intervals. In order to accomplish this type of data collection, triggers are sent wirelessly from the processor 84 to the vehicle data upload system 91 of the vehicle 12. The triggers in this example include computer readable code with instructions for requesting data from an associated sensor(s) 114 at predefined intervals or according to a data collection schedule (see reference numeral 208). It is to be understood that in order to transmit the data from the sensor(s) 114 to the telematics unit 14, the devices 114 and 14 must be within the range of the short-range wireless communication units/systems 48, 116 within the respective devices 14, 114. As such, the predefined intervals may be based upon, for example, the sensor(s) 114 to be used and a driving history of the vehicle 12. For example, if a user has signed up to have the telematics unit 14 collect and transmit electricity data from the sensor(s) 114 at the user's garage address, the predefined intervals may be based upon the driving patterns of the vehicle 12. If the user typically leaves the garage address at 7 am five out of seven days a week, the trigger for data collection may be set at 4:30 am everyday. As another example, if a user has signed up to have the telematics unit 14 collect and transmit electricity data from the sensor(s) 114 at a public facility near the user's workplace, the predefined intervals may also be based upon the driving patterns of the vehicle 12. If the user typically passes the facility at 7 am five out of seven days a week, the trigger for data collection may be set at 6:55 am everyday. In still another example, the predefined interval can be based upon the vehicle 12 arriving at a particular address (e.g., the vehicle arrives at his/her residence defined by his/her garage address). In another example, transmission of the data at predetermined intervals may be determined by the telematics unit 14; and not necessarily in response to a trigger. In this example, the telematics unit 14 may be configured, e.g., to receive and report sensor 114 data whenever the ignition is in an ON state.

In the examples where a trigger is used for receiving data by the telematics unit 14, the triggers are stored in a memory 38 of the telematics unit 14. When a trigger is activated, the VDU 91 commands (by transmitting appropriate signals) the short-range wireless communication network 48 to link to the short-range wireless communication network 116. Once the trigger is activated, the link request may be transmitted multiple times until the link between the devices 14 and 114 is established, or until a predetermined time has expired and the VDU 91 times out. It is to be understood that the link is transmitted by the short-range wireless pairing. It is further to be understood that, if sensor(s) 14 is/are broadcasting data (as will be described in further detail below), a link request would not be required, and short range wireless pairing will be used to transmit data.

Since in this example the sensor(s) 114 contain the profile of the requesting telematics unit 14, the sensor(s) 114 may authenticate the telematics unit 14 prior to establishing a short-range wireless connection with the telematics unit 14. The request from the VDU 91 contains the identifier or name of the telematics unit 14, and the sensor(s) 114 contain software (which is executable by an embedded processor (not shown in FIG. 1)) configured to compare the received identifier/name with the stored identifier name, and if a match is found, the link may be established. It is to be understood, however, that some sensors (such as, e.g., water level sensors, radiation level sensors, and/or other sensors that have been designated as readable by the public) would not require authorization for communication with the telematics unit 14.

When the short-range connection is established, the VDU 91 requests (by transmitting appropriate signals) the sensor(s) 114 to transmit the most recently collected reading to the receiver 51 or to take a reading and transmit the data resulting from the reading (see reference numeral 210). The sensor(s) 114 (via the processor embedded therein) is configured with appropriate software routines for encrypting the raw sensor data, and for including in the data message a non-encrypted sensor identifier (which enables the data aggregator 112 to transmit the data to the appropriate facility 120).

In some instances, the sensor(s) 114 may consistently (during a power ON cycle) transmit raw sensor data messages. As such, once the short-range connection is established, the telematics unit 14 will not need to request such data, but rather can simply acquire the data that is already being transmitted.

The data message is received at the receiver 51 of the telematics unit 14 via the short-range communication networks 48, 116. As shown at reference numeral 212, the telematics unit 14 may then transmit the data received from the sensor 114 to the data aggregator 112. In instances where the data aggregator 112 is embedded in the telematics unit 14, such transmission is accomplished internally within the telematics unit 14. However, in instances where the data aggregator 112 is located remote from the telematics unit 14 (such as at the data center 100, at the facility 120, or at the third party computing facility 117), transmission of the data to the data aggregator 112 may be accomplished over a voice channel or as packet data. The uploading of the data message takes place during a vehicle data upload event. In this example, the vehicle data upload event takes place as part of the predefined interval. More particularly, the vehicle data upload (VDU) system 91 pulls the data message from the receiver 51, packetizes and places the data in a suitable format for transmission to the data aggregator 112, and uploads the data message to the remotely-located data aggregator 112. In some cases, the sensor 114 data received by the telematics unit 14 is already packetized. In instances where the wireless communication system 16 is different from the short-range wireless technology between the telematics unit 14 and the sensor(s) 114, the packetized data may be re-packetized and then transmitted to the data aggregator 112. It is to be understood that the vehicle 12 bridges the sensor(s) 114 and the data aggregator 112, but generally is not configured to decode or otherwise process the data messages received from the sensor(s) 114.

If the connection is not established and data is not transmitted from the sensor(s) 114 to the receiver 51, the processor 36 is configured to generate a data message indicating that a connection was not made and data was not received. This data message may be transmitted to data center 100 as previously described so that the data center 100 can inform the facility 120 that no reading exists for this particular predefined interval.

Once the data aggregator 112 receives the data message (whether it is embedded in the telematics unit 14, located at the data center 100, the facility 120, or at the third party computing facility 117), the data aggregator 112 utilizes the one or more identifiers associated with the telematics unit 14 or vehicle 12 to identify the vehicle 12. The data aggregator 112 can also read the sensor identification number present in the data message, and use this identification number as a query in the database 72 or 106 to identify the facility 120 associated with the particular sensor(s) 114 (and thus the data message). The data center 100 may store a list of all participating facilities 120, and may also include a list of the sensors 114 that belong to each respective facility 120. The data aggregator 112 includes computer readable code (via the processor associated therewith) to run the appropriate query to link the received data message with the proper facility 120. Once the facility 120 is identified, the data aggregator 112 can transmit the data message to the facility 120 (see reference numeral 214). In instances where the data aggregator 112 is embedded in the telematics unit 14, transmission may be accomplished via the telematics unit 14 establishing communication with the facility 120. In instances where the data aggregator 112 is located at the data center 100, transmission may otherwise be accomplished using the communications module 113 and a communication system (not shown) linking the two entities 100, 120. In instances where the data aggregator 112 is located at the third party computing facility 117, transmission of the data may be accomplished via the communications module 119 associated with the third party computing facility 117 linking such computing facility 117 with the facility 120.

In another example, the sensor 114 data may include routing information embedded therein, where such routing information identifies where the data should be transmitted to. Upon receiving the data at the data aggregator 112 from the telematics unit 14, the data aggregator 112 (via suitable software programs) recognizes the routing information, and then automatically transmits the data to the proper facility 120 identified by the routing information.

Figure 3:
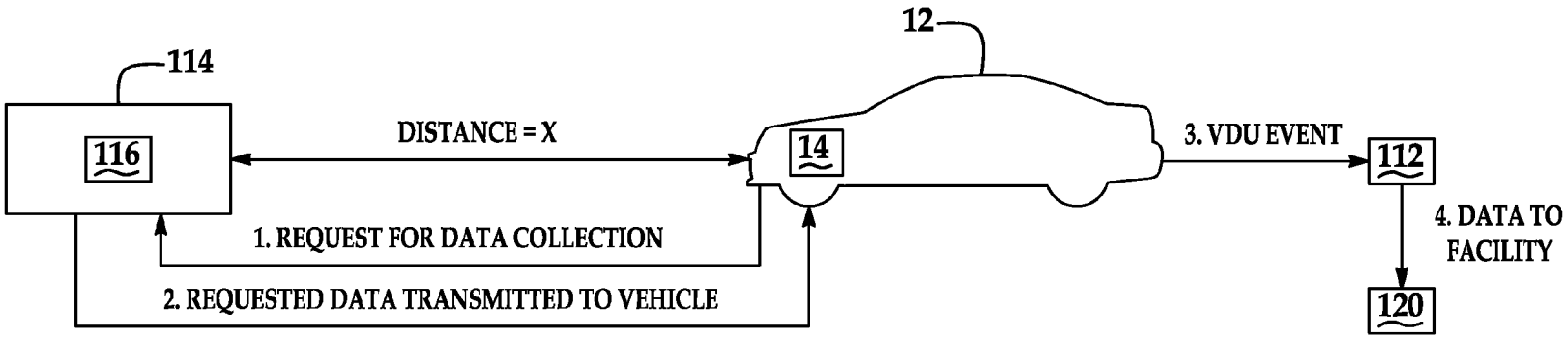
FIG. 3 is a schematic diagram of one example of the method shown in FIG. 2, illustrating some components of the system of FIG. 1.

As shown at reference numerals 216, 218, 212 and 214 of FIG. 2, another example of the method involves transmitting data whenever the vehicle 12 is within a predetermined distance of an associated sensor(s) 114. FIG. 3 also illustrates this example of the method. As shown in FIG. 3, X represents the predetermined distance between the vehicle 12 and the sensor(s) 114. It is to be understood that the predetermined distance X is based upon the range of the short-range wireless communication networks 48, 116 of both the vehicle 12 and the sensor(s) 114. This example may be particularly desirable for collecting data from a public facility meter, at least in part because the vehicle 12 may not be near such meter often enough to generate a data collection schedule for defining data collection intervals.

In order to accomplish this type of data collection, triggers are sent wirelessly from the processor 84 to the vehicle data upload system 91 of the vehicle 12. The triggers in this example include computer readable code with instructions for requesting data from an associated sensor(s) 114 whenever the devices 114 and 14 are within the range (X) of the short-range wireless communication units/systems 48, 116 (see reference numeral 216 of FIG. 2). This type of trigger is also stored in the memory 38 of the telematics unit 14. In one example, the telematics unit 14 is configured to consistently perform (during an ON cycle) a background scan for a signal from the sensor(s) 114. The sensor(s) 114 may also be configured to routinely (e.g., consistently while powered ON or at prescribed intervals (e.g., every 30 seconds, every minute, etc.)) send out a signal that is recognizable by the scanning telematics unit 14. In another example, the sensor(s) 114 is configured to consistently perform a background scan for a signal from the telematics unit 14. The telematics unit 14 may also be configured to routinely (e.g., consistently or at prescribed intervals (e.g., every 30 seconds, every minute, etc.)) send out a signal that is recognizable by the scanning sensor(s) 114.

When the signal from the sensor(s) 114 or telematics unit 14 is identified by the other of the devices 14 or 114, the stored trigger is activated, and the VDU 91 commands (by transmitting appropriate signals) the short-range wireless communication network 48 to link to the short-range wireless communication network 116. Since the devices 14 and 114 have already recognized each other, generally, in this example, the link request will be transmitted a single time before the connection is made.

Since, in this example, the sensor(s) 114 contains the profile of the requesting telematics unit 14, the sensor(s) 114 may authenticate the telematics unit 14 prior to establishing a short-range wireless connection with the telematics unit 14. As previously described, the request from the VDU 91 contains the identifier or name of the telematics unit 14, and the sensor(s) 114 contains software configured to compare the received identifier/name with the stored identifier name, and if a match is found, the link may be established.

When the short-range connection is established, the VDU 91 requests (by transmitting appropriate signals) the sensor(s) 114 to transmit the most recently collected reading to the receiver 51 or to take a reading and transmit the data resulting from the reading (see reference numeral 218). The sensor(s) 114 is configured with appropriate software routines for encrypting the raw sensor data, and also including in the data message a non-encrypted meter identifier (which enables the data aggregator 112 to determine what the data is and to transmit the data to the appropriate facility 120).

In some instances, the signal transmitted by the sensor(s) 114 includes then-current raw sensor data, and thus the telematics unit 14 will not need to request such data, but rather can acquire the data after the communication link is established.

The data message is received at the receiver 51 of the telematics unit 14 via the short-range communication networks 48, 116. As shown at reference numeral 212 and as previously described, the telematics unit 14 may then transmit the data received from the sensor 114 to the data aggregator 112. In this example, the vehicle data upload event takes place in response to receiving the data message at the telematics unit 14, and occurs in the manner previously described. Once the data aggregator 112 receives the data message, the module 112 reads the sensor identification number present in the data message, and uses this identification number to determine which facility 120 is associated with the particular sensor(s) 114. Once the third party facility 120 is identified, the data aggregator 112 transmits the data message to the proper facility 120 (see reference numeral 214).

As shown at reference numerals 220 through 224, 212 and 214 of FIG. 2, still another example of the method involves transmitting data on demand in response to a command from either the data center 100 or the facility 120. The trigger in these examples of the method is simply a data message received from either the data center 100 or the facility 120 which includes computer readable code with instructions for requesting data from an associated sensor(s) 114 (see reference numeral 220 of FIG. 2). This type of trigger is generally not stored in the memory 38 of the telematics unit 14, but rather is acted upon instantaneously or at some time set forth in the received instructions.

When the data center 100 sends the command, it may be in response to a request from the facility 120. This request may be made, for example, in emergency situations, such as during a flood, an earthquake, a hurricane, a tsunami, etc. When the facility 120 sends the command, an employee, advisor, etc. (not shown in FIG. 1) at the facility 120 may want or need a particular reading from a particular sensor(s) 114. In such an instance, he/she can request that the data center 100 send contact information for one or more vehicles 12, 12', 12" paired with the desired sensor(s) 114. Such a request may be made, for example, by contacting an advisor 62, 62' at the data center (or an advisor 104, 104' at the application center 24) and requesting such information. The data center 100 can ping vehicles 12, 12', 12" who have subscribed to the data collection program for location information to determine which, if any, vehicles are within close proximity to the desired sensor 114. In response to the message from the data center 100, the telematics units 14 in an ON state will transmit their respective then-current location information (e.g., latitude/longitude coordinates, a particular street address, etc.) to the data center 100, and the advisor 62, 62' (or 104, 104') can determine which vehicle(s) 12, 12', 12" are within a predetermined distance of the desired sensor(s) 114 using a mapping application configured to electronically illustrate the entered/received location coordinates. The contact information for one or more vehicles 12, 12', 12' located at or near the sensor(s) 114 may be transmitted to the facility 120, which can then (using processor 122) transmit the command to the telematics unit 14 of one or more of the identified vehicles 12, 12', 12". The command may otherwise be transmitted to the telematics unit 14 of the identified vehicles 12, 12', 12" directly from the data center 100.

In another example, when the facility 120 sends the command for a particular reading from a particular sensor 114, the command may be directed to the data center 100 to determine which vehicles 12, 12', 12" are capable of receiving (or in some cases authorized to receive) data from that particular sensor 114. The vehicles 12, 12', 12" capable of receiving (or authorized to receive) the data may be determined at the data center 100 by consulting a table of vehicles stored in the database 72. This table generally includes all of the vehicles 12, 12', 12" whose owners are then-currently engaged in a subscription contract with the data center 100, and which of these vehicles 12, 12', 12" can or are authorized to receive data from the sensor 114 in question. The data center 100 can ping the vehicles 12, 12', 12" selected from the table for location information to determine which, if any, of these vehicles 12, 12', 12" are within close proximity of the desired sensor 114. In response to the message, the vehicles 12, 12', 12" transmit their respective then-current location information to the data center 100, and the advisor 62, 62' (or 104, 104') can determine which vehicle(s) 12, 12', 12" are within a predetermined distance of the desired sensor(s) 114 using the mapping application. The contact information for one or more vehicles 12, 12', 12' located at or near the sensor(s) 114 may be transmitted to the facility 120, which can then (using processor 122) transmit the command to the telematics unit 14 of one or more of the identified vehicles 12, 12', 12". The command may otherwise be transmitted to the telematics unit 14 of the identified vehicles 12, 12', 12" directly from the data center 100.

Upon receiving the command from the data center 100 or the facility 120, the VDU 91 commands (by transmitting appropriate signals) the short-range wireless communication network 48 to link to the short-range wireless communication network 116. If the sensor(s) 114 contains the profile of the requesting telematics unit 14, the sensor(s) 114 may authenticate the telematics unit 14 prior to establishing a short-range wireless connection with the telematics unit 14. As previously described, this type of request from the VDU 91 contains the identifier or name of the telematics unit 14, and the sensor(s) 114 contains software configured to compare the received identifier/name with the stored identifier name, and if a match is found, the link may be established. If the sensor(s) 114 does not contain the profile of the requesting telematics unit 14, the telematics unit 14 may transmit its profile as part of the linking process.

When the short-range connection is established, the VDU 91 requests (by transmitting appropriate signals) the sensor(s) 114 to transmit the most recently collected reading to the receiver 51 or to take a reading and transmit the data resulting from the reading (see reference numeral 222). The sensor(s) 114 is configured with appropriate software routines for encrypting the raw sensor data, and also including in the data message a non-encrypted meter identifier (which enables the data aggregator module 112 to transmit the data to the appropriate third party facility 120).

In some instances, the signal transmitted by the sensor(s) 114 is then-current raw sensor data, and thus the telematics unit 14 will not need to request such data, but rather can acquire the data after the communication link is established.

The data message is received at the receiver 51 of the telematics unit 14 via the short-range communication networks 48, 116. As shown at reference numeral 224, the routine for transmitting the data from the vehicle 12 will depend upon which entity sent the original command. If the data center 100 sends the command, the telematics unit 14 may transmit the data received from the sensor 114 to the data center 100 over a voice channel or as packet data (see reference numeral 212). The vehicle data upload to the data aggregator 112 takes place as previously described, and then the data is transmitted to the proper facility 120 as previously described.

If, however, the facility 120 sends the command, the telematics unit 14 may transmit the data received from the sensor 114 directly to the facility 120 over a voice channel or as packet data (see reference numeral 214). In this example, the data aggregator 112 is embodied at the facility 120, and the telematics unit 14 responds to the original command from the facility 120 by transmitting the data to the data aggregator 112 at the facility 120 (see reference numeral 225). As such, in this example, the vehicle data upload event transmits the data message directly from the VDU system 91 to the facility 120 using the communication system (e.g., system 16) linking the two entities.

Figure 4:
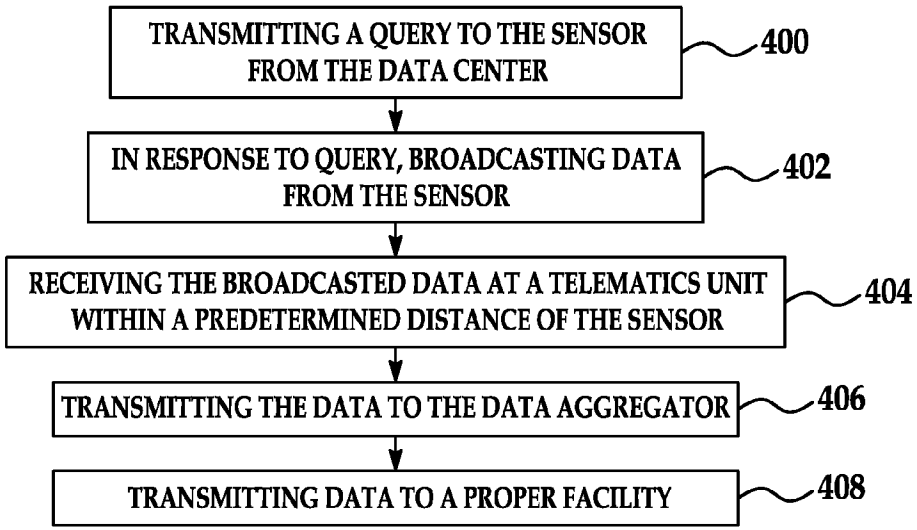
FIG. 4 is a flow diagram depicting another example of the method for collecting data.
Figure 5:
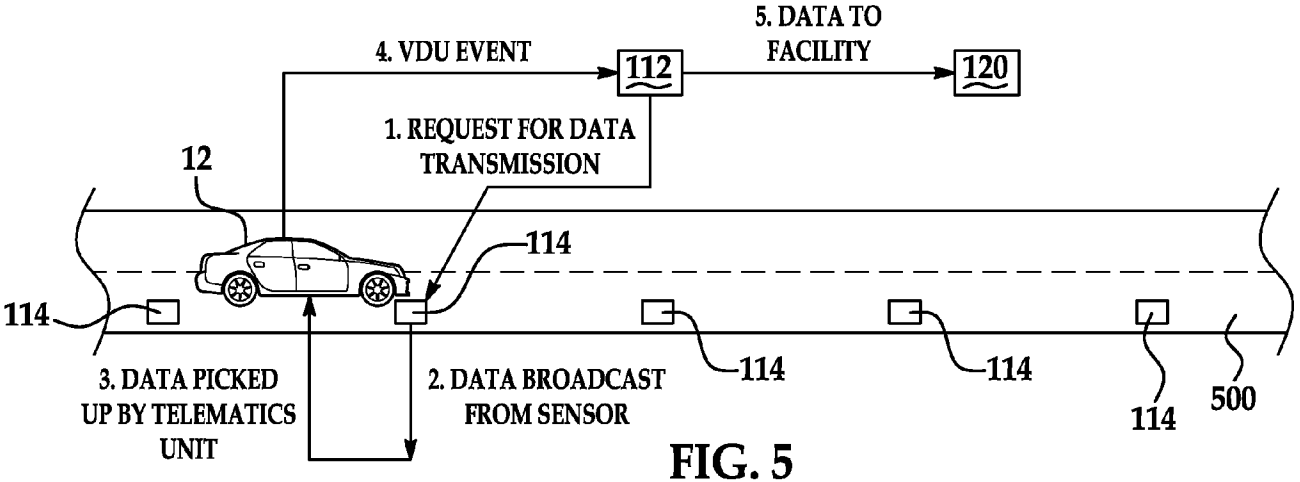
FIG. 5 is a schematic diagram of the method shown in FIG. 4, illustrating some components of the system of FIG. 1.

Referring now to FIGS. 4 and 5 together, another example of the method for collecting data is depicted. As illustrated in FIG. 5, the sensor(s) 114 may be embedded into a road segment 500, or otherwise located along the side of a road segment. Such sensor(s) 114 may, for example, be located in remote, less traveled, or potentially high risk areas, and may be used to collect readings of particular types of data such as radiation levels, water level activity along potential flooding areas over secondary road segments, and/or the like. The sensor(s) 114 may otherwise be located in more heavily traveled areas, and data obtained from the sensor(s) 114 may be used, for example, to deduce traffic levels. In such instances, it may not be desirable to pair the sensor(s) 114 to subscriber vehicles 12, 12', 12" in advance of the vehicles 12, 12', 12" traveling to such places, at least in part to free up memory in both the sensor(s) 114 and the telematics units 14 because the profile of the other device will not be stored therein.

In this example of the data collection method, the sensor(s) 114 is sent a query from the data center 100 (e.g., via the processor 84 and the communications module 113) or the facility 120 (e.g., via the processor 122 and a communications module associated therewith (not shown in FIG. 1)) requesting a data transmission from the sensor(s) 114 (see reference numeral 400). The query is a data message (transmitted via a wireless communication system 16) that identifies the sensor(s) 114 via a unique identifier. The sensor(s) 114 can act upon the instructions contained in the message when the unique identifier corresponds with the particular sensor(s) 114. In another example, a group of sensors 114 may be associated with the same identifier, or with a group number in a particular geographic area. In this example, the query message may identify all of the sensors 114 by virtue of the shared identifier or group number. These sensors 114 can then act upon the instructions contained in the message. The data message also instructs the sensor(s) 114 to broadcast (via the short-range communications network 116) the most recently acquired data. Such data may be gathered in response to the query or the most-recently stored data may be retrieved.

The queries may be sent at predefined intervals (e.g., based upon a fleet schedule that sends vehicles 12, 12', 12" to such locations at particular times and/or on particular days), or in response to the data center 100 or the facility 120 acquiring knowledge that a subscriber vehicle 12, 12', 12" will be in the area (e.g., a vehicle 12 requests navigation instructions which will lead the vehicle 12 across or along the road segment 500). In some instances, the vehicles 12, 12', 12" may operate in a blind or transparent mode, whereby such vehicles 12, 12', 12" are configured or requested to read and transmit any sensor data encountered.

In response to the query, the sensor(s) 114 broadcast the data message using the short-range communications network 116. The broadcast may be transmitted once, or multiple times if a telematics unit 14 does not link to the sensor(s) 114 after the first broadcast.

The telematics unit 14 is configured to consistently perform (during an ON cycle) a background scan for signal(s) from the sensor(s) 114 connected to or embedded in the road segment 500. When the broadcast is transmitted, if the vehicle 12 is within the broadcast range (i.e., the range of the sensor's short-range wireless communication network 116, which may be defined as distance X shown in FIG. 3), the vehicle 12 temporarily links with the sensor 114 and receives the broadcasted data message, as shown at reference numeral 404.

As shown at reference numeral 406, the receipt of the data message will trigger a vehicle data upload event, during which the received message is transmitted to the data aggregator 112, as previously described herein. In turn, the data aggregator 112 will identify the appropriate facility 120 and transmit the data message thereto (as shown at reference numeral 408).

Figure 7:
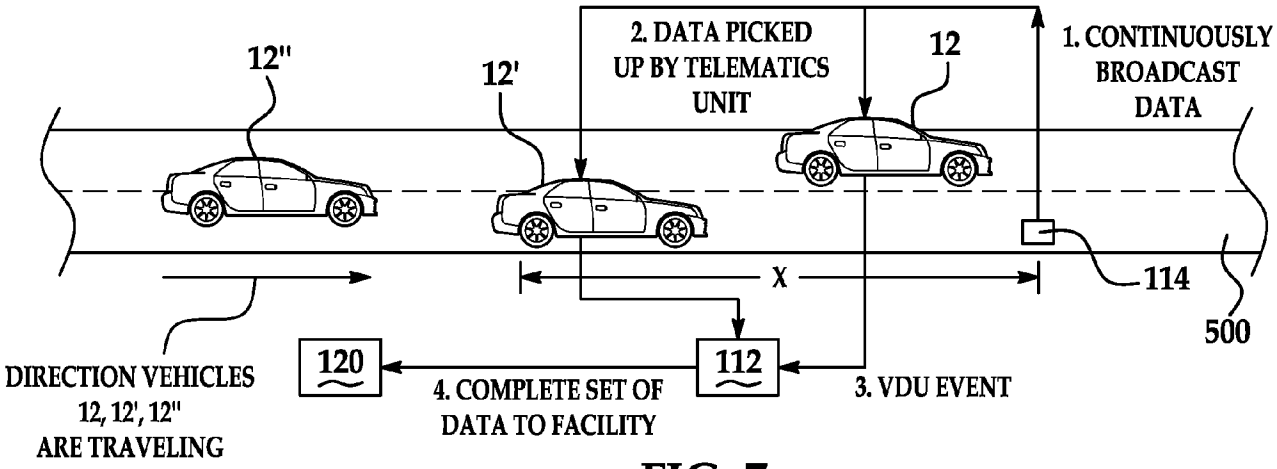
FIG. 7 is a schematic diagram of the method depicted in FIG. 8, illustrating some components of the system of FIG. 1.
Figure 8:
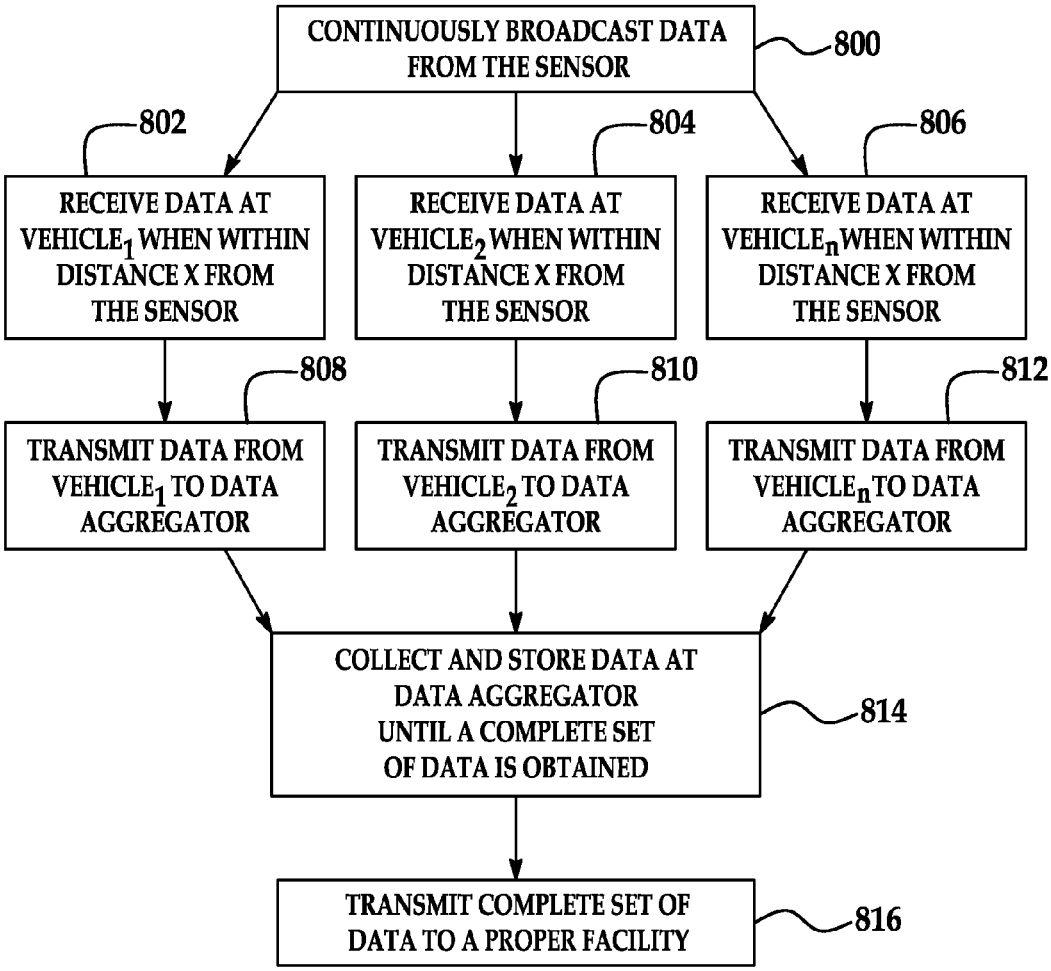
FIG. 8 is a flow diagram depicting yet another example of the method for collecting data.

Referring now to FIGS. 7 and 8, in another example, the sensor(s) 114 connected to or embedded in the road segment 500 substantially continuously broadcasts data without being queried by the data center 100 or the facility 120 (see reference numeral 800 in FIG. 8). The continuously broadcasted data may be obtained by participating subscriber vehicles 12, 12', 12" whenever such vehicles 12, 12', 12" come within a predefined distance X from the sensor 114 (see reference numerals 802, 804, and 806 in FIG. 8). Each of the vehicles 12, 12', 12" traveling within such distance X (such as, e.g., vehicles 12 and 12' shown in FIG. 7) collect at least some of the data broadcast from the sensor 114 as the vehicles 12, 12', 12" respectively travel along the road segment 500. For instance, if the vehicle 12 comes within the distance X from the sensor 114 connected to the road segment 500, depending at least in part on how fast the vehicle 12 is traveling, the telematics unit 14 collects at least some of the broadcasted sensor 114 data. When the vehicle 12 is traveling at a higher speed (e.g., 70 mph), the telematics unit 14 can typically collect part (or sometimes only a fraction) of the broadcasted data, whereas when the vehicle 12 is traveling at a slower speed (e.g., 15 mph), the telematics unit 14 can collect most, if not all of the broadcasted sensor 114 data.

In the instant example, the telematics unit 14 of the vehicles 12 transmits any of the data (even if such collected data is only a partial set of data) to the data aggregator 112 upon receiving such data from the sensor 114 (see reference numeral 808). The data aggregator 112 recognizes the type of data collected from the telematics unit 14 of the vehicle 12, and stores such data in an appropriate database (see reference numeral 814). As other participating subscriber vehicles (e.g., vehicles 12' and 12") travel along the road segment 500, more data is collected by their respective telematics units 14 (shown by reference numerals 804 and 806) and such data is then transmitted to the data aggregator 112 (see reference numerals 810 and 812). The data aggregator 122 again recognizes the data and stores it along with the other data collected from the vehicle 12 (see again reference numeral 814). Once the data aggregator 112 has obtained a complete set of data (which may come from a single vehicle 12 or from a plurality of vehicles 12, 12', 12"), such data is processed and then transmitted to the proper facility 120 (see reference numeral 816). In this particular embodiment (as shown in FIG. 7), the data aggregator 112 is located outside of the vehicles 12, 12', 12".

Figure 9:
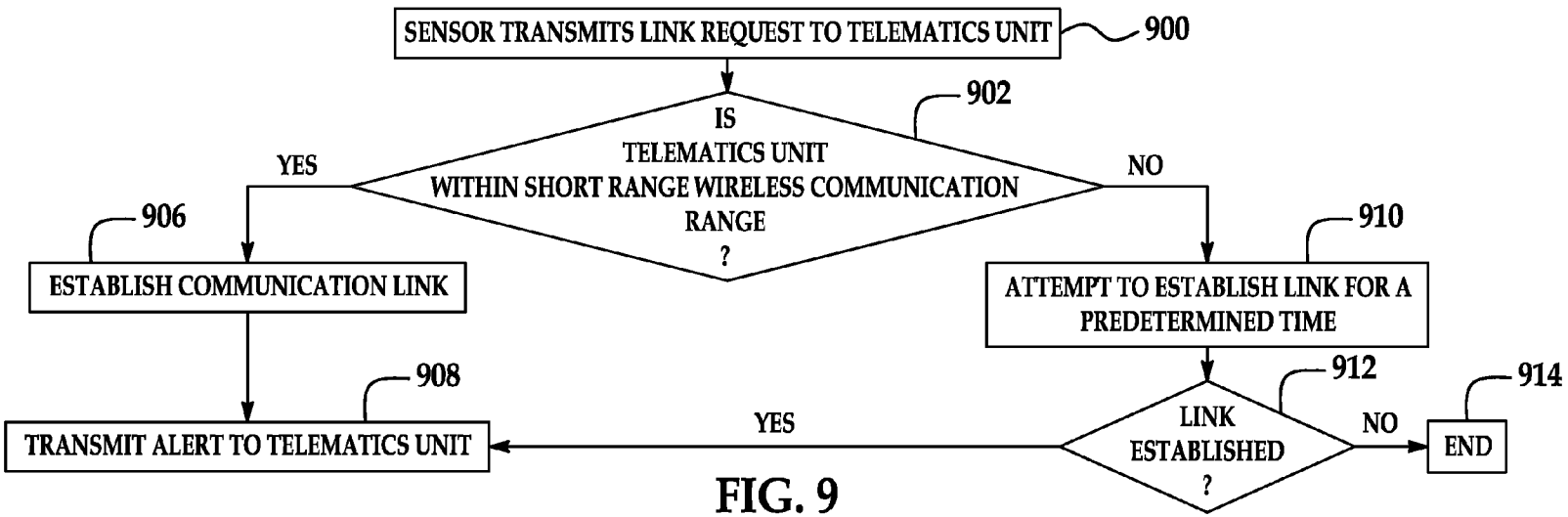
FIG. 9 is a flow diagram depicting another example of the method for collecting data.

Still another example of the data collecting method is shown in FIG. 9. In this example, the sensor(s) 114 commands its short-range wireless communication network 116 to link to the short-range wireless communication network 48, as shown at reference numeral 900. The network 116 transmits a link request signal, and when the telematics unit 14 is within the communication range (see reference numeral 902), the short-range wireless communication network 48 will link to the network 116. Such linking thereby forms a wireless data connection between the devices 114 and 14 (see reference numeral 906). It is to be understood that the link request signal may be transmitted multiple times for a predetermined time period until the link between the devices 14 and 114 is established (see reference numerals 910 and 908), or until the predetermined time has expired and the network 116 times out (see reference numeral 910 and 914).

Once a connection is made, the sensor(s) 114 transmits an alert signal (see reference numeral 908) notifying the telematics unit 14 (e.g., processor 36) of a potential danger related to a utility or other condition (e.g., radiation) with which the sensor(s) 114 is associated. The potential danger may be recognized by the sensor(s) 114 when a reading exceeds or falls below a threshold level. As such, the recognition of potential dangers is generally constrained to the sensor 114 and its particular application.

In this particular example, the alert signal is not encrypted and can be read and processed by the processor 36 of the telematics unit 14. In turn, the telematics unit 14 can transmit the message to the data aggregator 112, and ultimately to the proper facility 120, as previously described. The telematics unit 14 may also be configured to identify the alert signal as an alert (as opposed to a routine data message) and can display the alert on the display 80 of the vehicle 12 or generate an audible alert for transmission via the in-vehicle audio component 60. Such in-vehicle messages would alert the user of the vehicle 12 of the potential danger.

Figure 6:
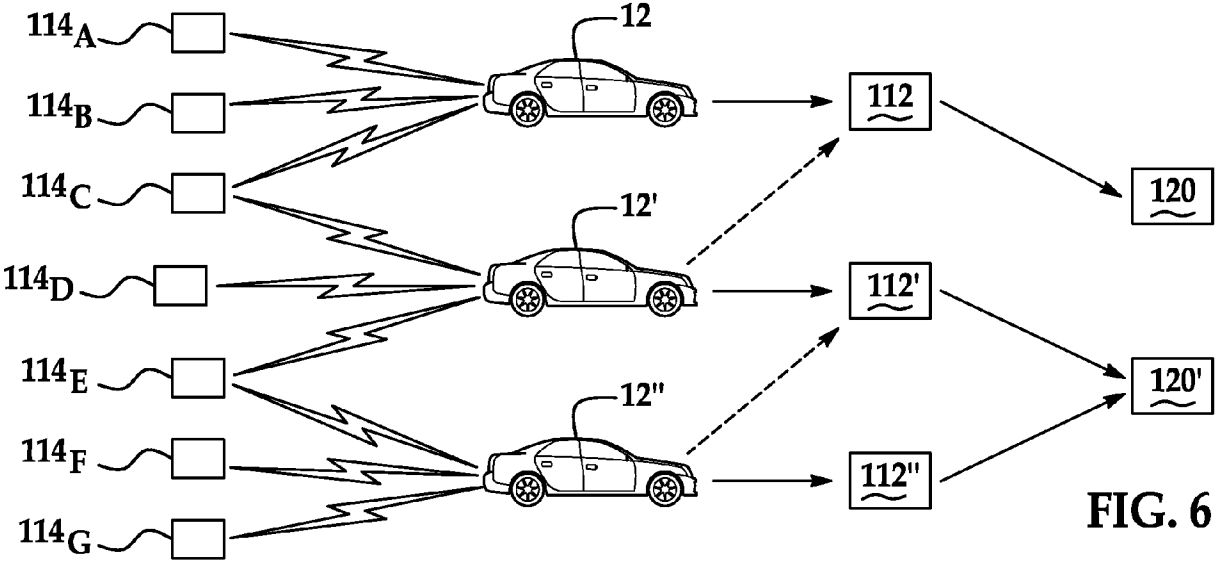
FIG. 6 is a schematic diagram depicting another example of a data collection system, including some of the components of the system depicted in FIG. 1.

In any of the embodiments disclosed herein, it is to be understood that the sensor(s) 114 may be linked to any number of subscriber vehicles 12, 12', 12" such that data is routinely transmitted to the data aggregator 112, and then ultimately to the proper facility 120. As shown in FIG. 6, each participating subscriber vehicle 12, 12', 12" is capable of receiving data from any sensor 114 so long as such vehicle 12, 12', 12" is authorized or otherwise allowed to receive data from a particular sensor 114. In some cases, a single sensor 114 may transmit data to a single vehicle (such as sensors $\mathbf{114}_A$, $\mathbf{114}_B$, $\mathbf{114}_D$, $\mathbf{114}_F$, and $\mathbf{114}_G$). In other cases, a single sensor 114 may transmit data to more than one vehicle (such as sensors $\mathbf{114}_C$ and $\mathbf{114}_E$). As described in detail above, the vehicles 12, 12', 12" receiving data from one or more of the sensors 114 transmits the data to the data aggregator 112. In some instances, a single data aggregator 112 may be used as the sole recipient of all of the sensor 114 data obtained by the vehicles 12, 12', 12" (such as shown and described in conjunction with FIGS. 1, 3, and 5). In other instances, a plurality of data aggregators 112, 112', 112" may be used to receive sensor 114 data from the vehicles 12, 12', 12". The vehicles 12, 12', 12" may individually be assigned a particular data aggregator 112 to transmit sensor 114 data to (which may have been set up when the user signed up for the data collection program). For example, all of the data obtained by vehicle 12 is transmitted to data aggregator 112, while all of the data obtained by vehicle 12' is transmitted to data aggregator 112'. The vehicles 12, 12', 12" may otherwise be configured to transmit sensor 114 data to a data aggregator 112 that is located within a predefined radius of the then-current location of the vehicle 12, 12', 12". For instance, if the vehicle 12' is located within the predefined radius of the aggregator 112, then all of the data obtained by the vehicle 12' is transmitted to the data aggregator 112. Furthermore, each data aggregator 112, 112', 112" is configured to transmit the data to the proper facility 120, even if such facility 120 receives data another data aggregator. For instance, the data aggregators 112' and 112" may transmit data to the same facility 120' so long as such facility 120' is determined to be the proper facility 120' for such data.

It is to be understood that, upon receiving the data from the data aggregator 112, the facility 120 utilizes the data in a prescribed manner. In instances where the data originally obtained by the telematics unit 14 from the sensor(s) 114 is encrypted, upon ultimately receiving the data at the facility 120, the data is decrypted using appropriate decryption software run by the processor 122. Once decrypted, the facility 120 can utilize the data in any desirable manner.

Furthermore, in each of the examples described above, a stamp of the vehicle's 12, 12', 12" location and time (taken, e.g., from the in-vehicle GPS component 44 and real time clock 46) may be transmitted along with the sensor 114 data to the data aggregator 112. Such information is particularly useful in instances where the sensors 114 are not aware of their respective locations and/or times when data is being transmitted. The location and time information may be used by the data aggregator 112 (or perhaps the data center 100 or the facility 120) to discover unknown sensors 114 (e.g., a sensor 114 embedded in a road segment that the facility 120 did not know was there). The location and time stamps are also useful when the sensor(s) 114 is mobile, at least in part because the information identifies at least the location of the sensor(s) 114 as well as the vehicle 12. Furthermore, the time stamp may be used for i) detecting trends in collected data, ii) creating vectors of and predicting where sensor-detected events or quanta exist (such as, e.g., a gas cloud, traces of radiation, etc.), and iii) graphically providing the collected data on a map.

While several examples have been described in detail, it will be apparent to those skilled in the art that the disclosed examples may be modified. Therefore, the foregoing description is to be considered exemplary rather than limiting.

The invention claimed is:

1. A method for collecting data, comprising:

selecting, via a processor operatively associated with a telematics service center, a mobile vehicle to collect data from a sensor configured to wirelessly communicate with one or more selected vehicles;

triggering a telematics unit operatively disposed in the selected mobile vehicle to perform a data reading of the sensor;

after the triggering and via the telematics unit, receiving data collected by the sensor;

via the telematics unit, transmitting the data from the telematics unit to a data aggregator; and reporting the data from the data aggregator to a facility.

2. The method as defined in claim 1 wherein the facility is a business facility associated with the sensor, and wherein the selecting is based on an arrangement established between an owner of the mobile vehicle and the business facility.

3. The method as defined in claim 1 wherein the triggering includes instructing the telematics unit to automatically perform a data reading of the sensor according to a prescribed data collection schedule.

4. The method as defined in claim 1 wherein the triggering includes transmitting an alert signal from the sensor to the telematics unit, the alert signal notifying the telematics unit of a potential danger related to a utility with which the sensor is associated.

5. The method as defined in claim 1 wherein the sensor is a public facility meter, and wherein the method further comprises:

authorizing the selected mobile vehicle to perform a data reading of the public facility meter; and automatically performing the data reading when the selected mobile vehicle is within a predefined distance from the public facility meter.

6. The method as defined in claim 1 wherein:

the sensor is a public facility meter that is operatively connected to a public road segment;

the triggering includes:

transmitting, from the telematics service center to the sensor, a query message requesting a data transmission; and broadcasting the data from the sensor to the telematics unit; and the broadcasted data is transmitted from the telematics unit to the data aggregator.

7. The method as defined in claim 6, further comprising transmitting location data in addition to the broadcasted data from the telematics unit to the data aggregator.

8. The method as defined in claim 1 wherein the sensor is a stationary device or a mobile device.

9. A method for collecting data, comprising:

selecting, via a processor operatively associated with a telematics service center, a mobile vehicle to collect data from a sensor configured to wirelessly communicate with one or more selected vehicles;

verifying that a telematics unit operatively disposed in the selected mobile vehicle has authorization to obtain the data;

after verification and via the telematics unit, receiving data collected by the sensor;

via the telematics unit, transmitting the data from the telematics unit to a data aggregator; and reporting the data from the data aggregator to a facility.

10. The method as defined in claim 9 wherein the obtaining of the data from the sensor includes transmitting the data, in an encrypted form, from the sensor to the authorized telematics unit.

11. A method for collecting data, comprising:

selecting, via a processor operatively associated with a telematics service center, a mobile vehicle to collect data from a sensor configured to wirelessly communicate with one or more selected vehicles;

via a telematics unit operatively disposed in the selected mobile vehicle, receiving data collected by the sensor;

via the telematics unit, transmitting the data from the telematics unit to a data aggregator; and reporting the data from the data aggregator to a facility;

wherein the sensor is associated with a personal utility meter, wherein the facility is a utility provider, and wherein the method further comprises:

authorizing the selected mobile vehicle to perform a data reading of the personal utility meter; and performing the data reading on demand from the utility provider.

12. A method for collecting data, comprising:

selecting, via a processor operatively associated with a telematics service center, a mobile vehicle to collect data from a sensor configured to wirelessly communicate with one or more selected vehicles;

via a telematics unit operatively disposed in the selected mobile vehicle, receiving data collected by the sensor;

via the telematics unit, transmitting the data from the telematics unit to a data aggregator; and reporting the data from the data aggregator to a facility;

wherein the selecting includes instructing the telematics unit to request a data reading from the sensor i) at predetermined intervals, ii) when located within a predetermined distance from the sensor, or iii) combinations of i and ii.

13. A data collection system, comprising:

a sensor configured to measure data usable by a third party facility;

a communications device operatively associated with the sensor, the communications device configured to transmit the measured data via a wireless connection;

a telematics unit disposed in a mobile vehicle, the telematics unit configured to obtain the data from the communications device;

a data aggregator in selective communication with the telematics unit, the data aggregator configured to i) receive the data from the telematics unit, and ii) report the data to an appropriate facility; and a telematics service center in selective and operative communication with the telematics unit, the telematics service center including a processor configured to run computer readable code for selecting the mobile vehicle to collect the data from the sensor.

14. The system as defined in claim 13, further comprising means for triggering the telematics unit to perform a data reading of the sensor.

15. The system as defined in claim 14 wherein the facility is a utility provider, wherein the sensor is a personal utility meter owned by the utility provider, and wherein the system further comprises:

means for authorizing the mobile vehicle to perform a data reading of the personal utility meter; and means for performing the data reading on demand from the utility provider.

16. The system as defined in claim 14 wherein the sensor is a public facility meter, and wherein the system further includes:

means for authorizing the mobile vehicle to perform a data reading of the public facility meter; and means for automatically performing the data reading when the mobile vehicle is within a predefined distance from the public facility meter.

17. The system as defined in claim 13 wherein the sensor is operatively connected to a public road segment, and wherein the system further includes:

a wireless connection established between the telematics service center and the sensor, the wireless connection enabling the telematics service center to transmit a query message to the sensor requesting a data transmission;

a short-range communications network operatively connecting the sensor and the telematics unit, the short-range communications network configured to broadcast the data from the sensor to the telematics unit; and an other wireless connection established between the telematics unit and the data aggregator, the other wireless connection enabling the telematics unit to transmit the broadcasted data to the data aggregator.

18. The system as defined in claim 13 wherein the sensor is a personal utility meter, a public utility meter, a road traffic sensor, a water body level sensor, or a seismic sensor.

* * * * *